US006126089A

United States Patent [19]

Williamson et al.

[11] Patent Number: 6,126,089

[45] Date of Patent: Oct. 3, 2000

[54] CLEANING LANCE

[75] Inventors: Martin Williamson, Lasne, Belgium; Colin J Kirk, Duffield, United Kingdom

[73] Assignee: Deb Ip Limited, Belper, United Kingdom

[21] Appl. No.: 09/254,104

[22] PCT Filed: Sep. 4, 1997

[86] PCT No.: PCT/GB97/02373

§ 371 Date: Jun. 1, 1999

§ 102(e) Date: Jun. 1, 1999

[87] PCT Pub. No.: WO98/09739

PCT Pub. Date: Mar. 12, 1998

[30] Foreign Application Priority Data

Sep. 9, 1996 [GB] United Kingdom ..... 9618772

[51] Int. Cl.[7] ..... A62C 5/02; B05B 7/26

[52] U.S. Cl. ..... 239/310; 239/407; 239/427.5; 239/428.5; 239/432; 137/901; 137/876; 137/627; 134/100.1; 134/99.2; 134/95.3; 134/123

[58] Field of Search ..... 239/310, 316, 239/311, 318, 335, 336, 340, 343, 344, 353, 390, 396, 397, 407, 413, 414, 416, 427.3, 427.5, 428.5, 432, 518, 443; 137/901, 876, 625.11, 627; 134/100.1, 99.2, 95.3, 123

[56] References Cited

U.S. PATENT DOCUMENTS

| | | | |
|---|---|---|---|
| 2,965,309 | 12/1960 | Parrott | 239/310 |
| 4,204,295 | 5/1980 | Kränzle | 239/11 |
| 4,277,030 | 7/1981 | Hechler, IV | 239/407 |
| 4,613,074 | 9/1986 | Schulze | 239/1 |
| 5,085,371 | 2/1992 | Paige | 239/428.5 |
| 5,445,226 | 8/1995 | Scott et al. | 169/15 |
| 5,595,345 | 1/1997 | Chura et al. | 239/318 |
| 5,850,973 | 12/1998 | Liljeqvist et al. | 239/318 |

FOREIGN PATENT DOCUMENTS

| | | |
|---|---|---|
| 0596155 | 8/1994 | European Pat. Off. . |
| 2381956 | 9/1978 | France . |
| 2519881 | 7/1983 | France . |
| 3214180 | 10/1983 | Germany . |

*Primary Examiner*—Andres Kashnikow
*Assistant Examiner*—Lisa Ann Douglas
*Attorney, Agent, or Firm*—Ladas & Parry

[57] ABSTRACT

A cleaning lance provided in which water from an inlet is directed either to an upper, rinsing barrel or to a lower, foamer barrel. The latter is provided with a mixing chamber having an inlet for detergent supplied via a flow control valve. A water jet injected into the mixing chamber via a venturi nozzle draws in and mixes with the detergent and the resulting mixture is ejected by a further venturi nozzle and draws in air from an exterior air inlet to form a jet of cleaning foam.

3 Claims, 2 Drawing Sheets

CLEANING LANCE

The present invention relates to a cleaning lance, of the type used for cleaning the exterior of vehicles for example. Such cleaning lances normally incorporate a barrel having a high pressure nozzle which is used to direct a high pressure water jet at the exterior of the vehicle. Such cleaning lances are normally supplied with pressurised water from a pump driven by an electric motor or a petrol engine and in many cases detergent is fed into the water flow at the site of the pump.

FR-1,363,426 discloses a cleaning lance having a mixing chamber in which an axially directed water jet sucks in air from an air inlet and detergent from a detergent inlet and forms a foam which is ejected axially from the outlet of the chamber. The air inlet and detergent in let are diametrically opposed within the mixing chamber.

FR-A-2,519,881 discloses a hand held cleaning lance having two barrels mounted on a common body and valve means incorporated in the body of the lance and operable by the user to switch pressurised fluid from an inlet of one barrel to an inlet of the other barrel, the barrels being arranged to form jets of different characteristics and the valve means comprising a freely movable valve member which is retainable by fluid pressure to selectively block said inlets.

However, in FR-A-2,519,881 the two barrels are located side by side and the movable valve member is movable by inclining the lance slightly about its longitudinal axis.

Since only one of the barrels is connected to a detergent bottle, and the barrels are in any case of different lengths and bore sizes, an unbalanced arrangement results, which is not ergonomic.

A further problem with the above arrangement is that the valve member easily rolls from one side to the other if pressure is interrupted, so it is possible to accidentally switch to a detergent stream. This can be dangerous because detergent is sometimes corrosive.

U.S. Pat. No. 4,202,495 discloses a nozzle head selector for one or more nozzles located at the end of a single barrel, the selector being located at the nozzle end of the barrel. The selector has a changeover device formed by a ball which moves under gravity when the pressure is turned off to allow changeover of jets without changing the nozzle head, the jet being selected by slightly turning the barrel. Such a changeover device in being located at the nozzle end is able to operate under lower pressures and although some leakage may be acceptable at the nozzle end, no leakage is acceptable at a user end of a cleaning lance.

The present invention seeks to at least partially mitigate the foregoing difficulties.

In accordance with this invention there is provided a cleaning lance comprising a mixing chamber having two adjacent barrels, a first barrel being arranged to form a rinsing stream and a second barrel being arranged to form a stream of mixed water and detergent, the first and second barrels having a common water inlet and valve means for selectively coupling the water inlet to a respective one of the barrels and a coupling arranged to support a detergent container below both barrels, the detergent being admitted into said second barrel wherein in the second barrel there is provided a mixing chamber where by Venturi action the water injected into the mixing chamber is mixed with detergent from said container and ejected from an outlet nozzle, wherein said first and second barrels are located one above another, in use, with the coupling being arranged to hold the container being located below the barrels, a mesh being located in the second barrel downstream of the mixing chamber for foaming the mixture, the first and second barrels being coupled by latching valve means to a common water inlet, the valve means having a default position in which said valve means selectively couples the first barrel to the water inlet, said valve means being operable by a user on reducing water pressure at the water inlet; wherein said valve means comprises a rolling or sliding valve member which is movable to selectively block one of a lower inlet to the second barrel and an upper inlet to the first barrel, and said valve means defines a curved path for the valve member as it moves, in use, between its selective blocking positions.

Other preferred features of the invention are defined in the dependent claims.

The above arrangement is more ergonomic than that of FR-A-2,519,881 and particularly in view of U.S. Pat. No. 4,202,495 by particularly having a valve means comprising an elongate arcuate (preferably semi-circular) chamber having an inlet and having respective spaced apart outlets communicating with the barrels, a rolling or sliding valve member (such as a steel ball for example) being located in the chamber and being arranged to move within the chamber to block one of the outlets on tilting the lance and to block the other of the outlets automatically (e.g. by the action of gravity) when the pressure is interrupted. To this end, the lance is preferably provided with trigger means for blocking fluid pressure to enable such movement of the valve member and for reapplying fluid pressure to maintain the valve member in position against the last-blocked outlet by fluid pressure irrespective of the angle of tilt of the lance.

Preferably, however, the valve means is latched by fluid pressure which allows for rapid change in comparison with a non-latching, manually operated arrangement which involves a significant delay and dividing of the flow.

Further preferred features are defined in the dependent claims.

A preferred embodiment of the invention is described below by way of example only with reference to FIGS. 1 and 2 of the accompanying drawings wherein.

Figure 1A:
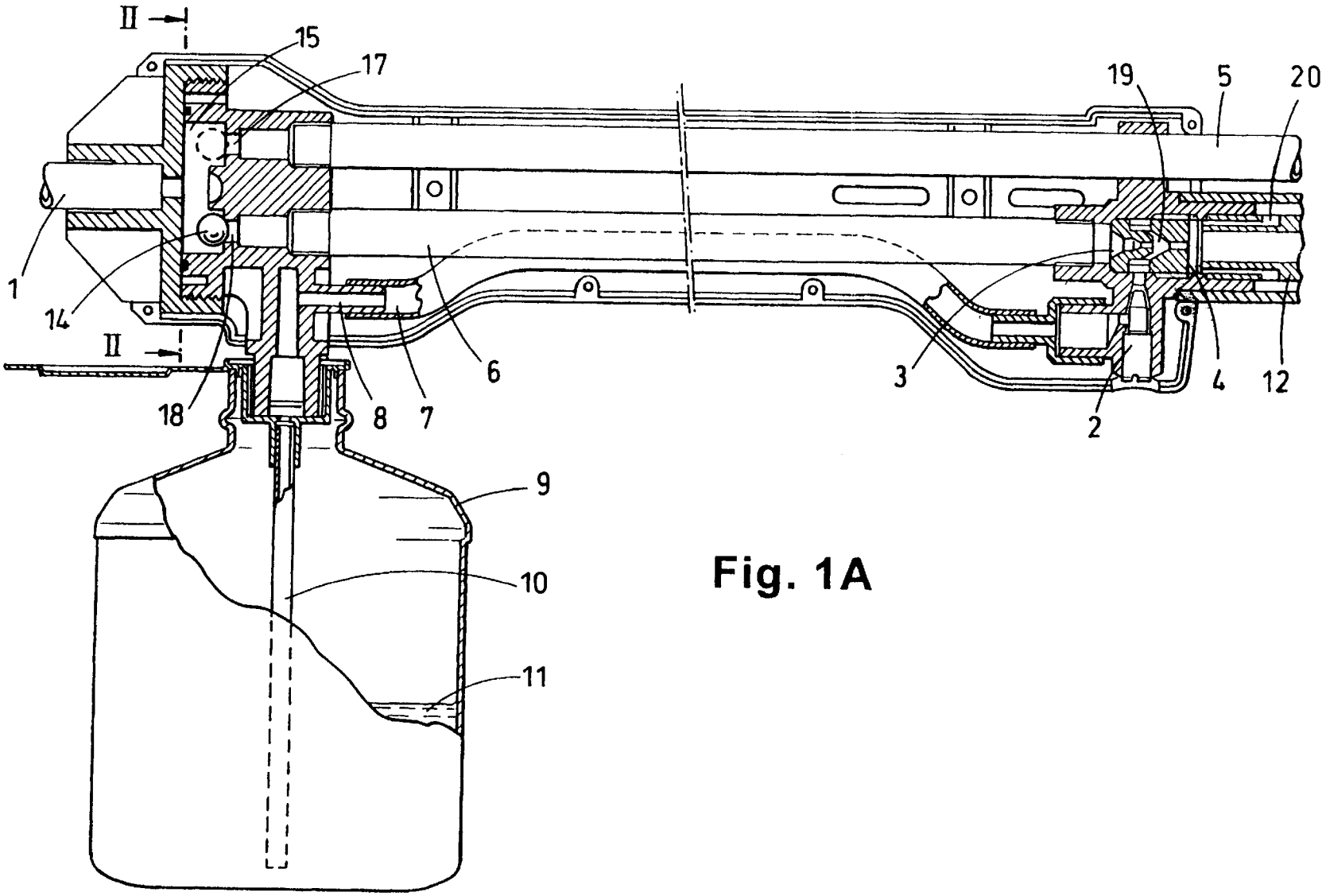
FIG. 1A is a longitudinal cross-section showing the proximal end and mid-portion of a cleaning lance in accordance with the invention.
Figure 2:
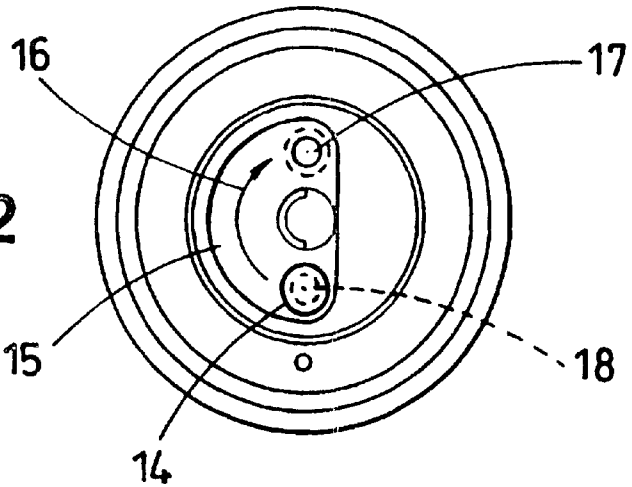
FIG. 2 is a section taken on II—II of FIG. 1A.

Referring to FIG. 1A, an elongate cleaning lance is shown to comprise a water inlet 1 provided with a trigger attachment (not shown) for applying and releasing water under pressure. The water inlet 1 communicates with a valve comprising a steel ball 14 which runs within a semi-circular ball valve chamber 15 as best seen in FIG. 2. The ball 14 has a lower default position in which it blocks an inlet 18 to the foamer barrel 12 and has an upper position at which it blocks an inlet 17 to a pressure stream barrel 5 which generates a water jet. As shown in FIG. 2, the path 16 of the steel ball 14 between these two extreme positions is semi-circular and accordingly it can be moved between these two positions by tilting the lance about its longitudinal axis after releasing the pressure with the trigger attachment connected to water inlet 1.

Figure 1B:
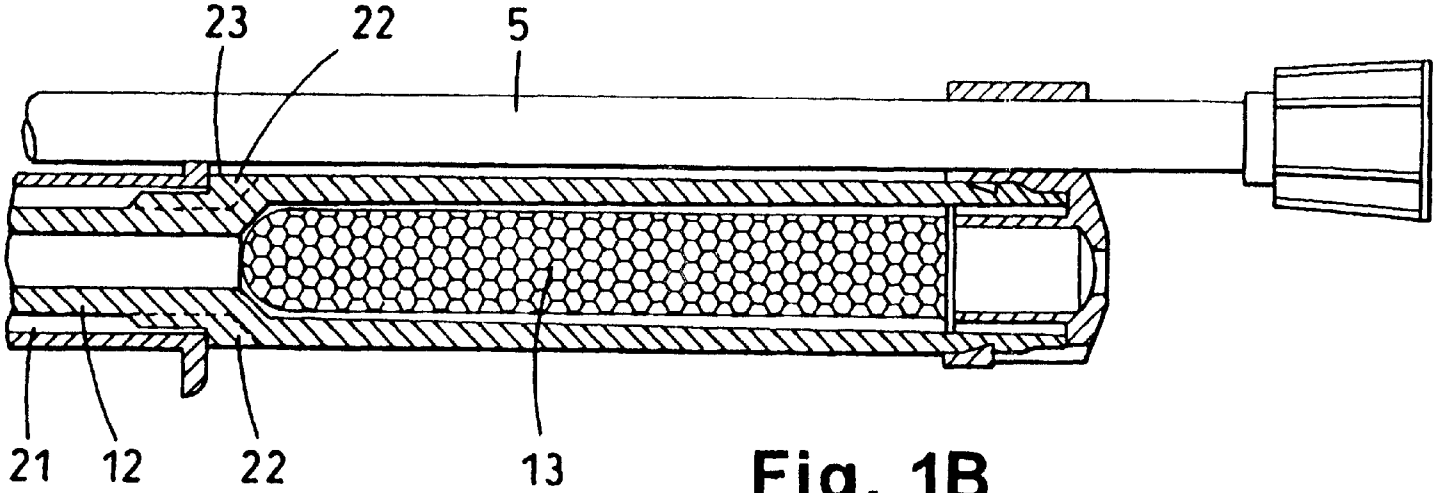
FIG. 1B shows the distal portion of the cleaning lance of FIG. 1A.

A water jet is formed within a mixing chamber 19 by a Venturi nozzle 3 which is supplied with high pressure water by conduit 6 from inlet 18. The resulting jet draws in detergent 11 via a feed tube 10, mounting 8, detergent conduit 7 and needle valve 2 which controls the flow of detergent into the mixing chamber 19. The resulting mixture of water and detergent exits the mixing chamber via a further Venturi nozzle 4 which draws in air by Venturi action through an annular air inlet 20 which communicates with an annular passage 21 (FIG. 1B) which in turn has an air inlet open 23 to the atmosphere. The mixture of air, water and detergent passing along the foamer barrel 12 is foamed by a mesh 13 (FIG. 1B) and forms a stream of cleaning foam. The mesh is a conventional mesh of plastics material (polypropylene or nylon).

Annular passage 21 extends axially of the lance around barrel 12 and at its end remote from that end coupled with air inlet 20 there is provided one or more axially extending walls circumferentially spaced about the outer peripheral surface of the barrel 12 and defining passages therebetween communicating with the external atmosphere via opening(s) 23 in the external surface of barrel 12 prior to but adjacent to foaming mesh 13 in the direction of movement of the water detergent and air mixture through barrel 12. Therefore when air is required it is drawing through opening 23 into the passages between walls 22 and then into the Venturi 4 via the annular passage 21 and air inlet 20.

A removable detergent cartridge 9 provided with its own detergent feed tube 10 and associated cap is attachable to mounting a by a standard bayonet fitting (not shown).

Referring to FIG. 2, it will be noted that the ball 14 will normally fall to the lower position at which it blocks inlet 18 by the action of gravity. On releasing the water pressure at inlet 1 and tilting the lance anticlockwise by 180° about its longitudinal axis, the ball 14 can be moved to block inlet 17 and at this point pressure can be reapplied by the trigger (not shown) to maintain the ball in this position and form a foam jet by flow through inlet 18 to mixing chamber 19. When it is desired to wash off the foam, the water pressure is momentarily released by releasing the trigger, the lance is tilted slightly about its longitudinal axis to enable the ball 14 to roll back to its lower position, and fluid pressure is then reapplied by the trigger, allowing water to flow directly via inlet 17 to the upper barrel to form a cleaning stream.

The cleaning lance of the present invention can be used not only for vehicle cleaning but also for other cleaning applications, such as abattoir sanitising for example.

What is claimed is:

1. A cleaning lance comprising two adjacent barrels, a first barrel being arranged to form a rinsing stream and a second barrel being arranged to form a stream of mixed water and detergent, the first and second barrels having a common water inlet and valve means for selectively coupling the water inlet to a respective one of the barrels and a coupling arranged to support a detergent container below both barrels, the detergent being admitted into said second barrel wherein in the second barrel there is provided a mixing chamber where by Venturi action the water injected into the mixing chamber is mixed with detergent from said container and ejected from an outlet nozzle wherein said first and second barrels are located one above another, in use, with the coupling being arranged to hold the container being located below the barrels, a mesh being located in the second barrel downstream of the mixing chamber for foaming the mixture, the first and second barrels being coupled by latching valve means to a common water inlet, the valve means having a default position in which said valve means selectively couples the first barrel to the water inlet, said valve means being operable by a user on reducing water pressure at the water inlet; wherein said valve means comprises a rolling or sliding valve member which is movable to selectively block one of a lower inlet to the second barrel and an upper inlet to the first barrel, and said valve means defines a curved path for the valve member as it moves, in use, between its selective blocking positions.

2. A cleaning lance as claimed in claim 1, wherein the valve means is switchable between its selective blocking positions by tilting or rotating the lance.

3. A cleaning lance as claimed in claim 1, wherein the detergent supply is located near a proximal end of the cleaning lance and is spaced apart from and communicates with the mixing chamber via a conduit provided with a flow control valve, the mixing chamber being located at one of the mid portion and distal end of the cleaning lance.

* * * * *

UNITED STATES PATENT AND TRADEMARK OFFICE

CERTIFICATE OF CORRECTION

PATENT NO. : 6,126,089
DATED : October 3, 2000
INVENTOR(S) : Martin Williamson

It is certified that error appears in the above-identified patent and that said Letters Patent is hereby corrected as shown below:

Title page,
Item 73, "Ip" should read --IP--.

Signed and Sealed this

Third Day of July, 2001

*Attest:*

Nicholas P. Godici

*Attesting Officer*

NICHOLAS P. GODICI
*Acting Director of the United States Patent and Trademark Office*